US011305167B2

(12) United States Patent
Czarnecki

(10) Patent No.: US 11,305,167 B2
(45) Date of Patent: Apr. 19, 2022

(54) MARTIAL ARTS TRAINING DEVICE

(71) Applicant: Brian E. Czarnecki, Virginia Beach, VA (US)

(72) Inventor: Brian E. Czarnecki, Virginia Beach, VA (US)

( * ) Notice: Subject to any disclaimer, the term of this patent is extended or adjusted under 35 U.S.C. 154(b) by 0 days.

(21) Appl. No.: 16/896,622

(22) Filed: Jun. 9, 2020

(65) Prior Publication Data

US 2021/0379459 A1 Dec. 9, 2021

(51) Int. Cl.

| | |
|---|---|
| ***A63B 69/00*** | (2006.01) |
| ***A63B 69/34*** | (2006.01) |
| *A63B 21/02* | (2006.01) |

(52) U.S. Cl.

CPC ..... *A63B 69/004* (2013.01); *A63B 69/34* (2013.01); *A63B 21/023* (2013.01)

(58) Field of Classification Search

CPC ..... A63B 69/004; A63B 69/34; A63B 69/345; A63B 21/00047; A63B 21/023; A63B 21/04; A63B 21/0442; A63B 21/0407; A63B 21/0421; A63B 21/0428; A63B 21/0435; A63B 21/045; A63B 21/0455

See application file for complete search history.

(56) References Cited

U.S. PATENT DOCUMENTS 547,731 A * 10/1895 MacLearn ..... A63B 69/208 482/85
973,641 A 10/1910 Dysart
1,704,472 A 3/1929 Grandjean
2,909,370 A 10/1959 Fortney
2,913,245 A 11/1959 Lands
3,363,894 A 1/1968 Hill
4,088,315 A 5/1978 Schemmel
5,256,069 A 10/1993 Snowden, Jr
5,437,590 A 8/1995 D'Alto
5,700,230 A 12/1997 Cardona
5,971,398 A 10/1999 Broussard
7,055,812 B2 6/2006 Balsells
8,322,695 B2 12/2012 Sugar
8,641,583 B2 * 2/2014 Chen ..... A63B 69/20 482/83
8,777,818 B1 * 7/2014 Tate, Jr. ..... A63B 69/004 482/83
9,789,375 B2 * 10/2017 Salerno ..... A63B 69/004
10,258,856 B2 * 4/2019 Conley ..... A63B 69/32
2007/0249473 A1 * 10/2007 Robinson ..... A61K 47/02 482/83
2011/0118092 A1 5/2011 Keary, III
(Continued)

*Primary Examiner* — Megan Anderson
(74) *Attorney, Agent, or Firm* — Bryce D. Miracle, Esq.

(57) ABSTRACT

In accordance with a version of the invention, a martial arts training device is provided which allows solitary training, particularly with regard to clinch training. In certain versions of the application, the martial arts training device generally comprises: a base assembly having a top; a primary spring affixed to the top of the base assembly, the primary spring having a top and a bottom; a torso body assembly; a vertical adjustment assembly adapted to vertically translate the torso body assembly between a downward position and an upward position; and at least one bidirectional spring-biased assembly for yieldably maintaining the torso body assembly in a default resting position.

20 Claims, 15 Drawing Sheets

(56) References Cited

U.S. PATENT DOCUMENTS

| | | | | |
|---|---|---|---|---|
| 2011/0256990 | A1* | 10/2011 | Machado | A63B 69/345<br>482/83 |
| 2011/0281695 | A1 | 11/2011 | Machado | |
| 2013/0137554 | A1 | 5/2013 | Knight | |
| 2015/0167383 | A1 | 6/2015 | Arnold | |
| 2018/0154235 | A1 | 6/2018 | Rodriguez | |

* cited by examiner

MARTIAL ARTS TRAINING DEVICE

FIELD OF THE INVENTION

The present invention relates to training aids in the field of martial arts, in particular a clinch training device.

BACKGROUND

Martial arts are codified systems and traditions of combat practiced for a number of reasons such as self-defense; military and law enforcement applications; competition; physical, mental and spiritual development; entertainment; and the preservation of a nation's intangible cultural heritage.

Martial arts equipment can be used and configured for training, conditioning, and protection. Specialized martial arts training equipment can include breaking boards, dummy partners such as a wooden dummy, and targets such as punching bags. Protective equipment for sparring and competition includes boxing gloves and headgear.

Clinch fighting is the part of stand-up fighting where the combatants are grappling in a clinch, typically using clinch holds. Clinching the opponent can be used to eliminate the opponent's effective usage of some kicks, punches, and melee weapons. The clinch can also be used as a medium to switch from stand-up fighting to ground fighting by using takedowns, throws, or sweeps.

Currently, in order to properly train and improve the clinch, training must be conducted with a training partner with safety being the number one priority. Proper protective padding must be worn in order to maintain safety. Initially, the trainee places or hooks one hand or clasps both hands behind the trainer's head and neck then pulls and twists the head and neck to manipulate the trainer's body and head in the desired direction of the strikes the trainee is trying to utilize. Not only does this limit the strikes to areas that are protected by padding, the torso and hand mitts, but puts a strain on the neck and back of the trainer causing fatigue thus increasing risk of injury.

Therefore, it is much desirable to conduct martial arts training while solo without a partner, either by preference or out of necessity. Because it is essential to conduct clinch training with an opponent, solo training may not be an option in order to perfect this type of move. For the foregoing reasons, there is a need for an apparatus which provides the ability to practice the clinch move without requiring a live partner.

SUMMARY

In accordance with a version of the invention, a martial arts training device is provided which allows solitary training, particularly with regard to clinch training. In certain versions of the application, the martial arts training device generally comprises: a base assembly having a top; a primary spring affixed to the top of the base assembly, the primary spring having a top and a bottom; a torso body assembly; a vertical adjustment assembly adapted to vertically translate the torso body assembly between a downward position and an upward position; and at least one bidirectional spring-biased assembly for yieldably maintaining the torso body assembly in a default resting position.

In certain versions of the application, the bidirectional spring-biased assembly operably connects to a point above the primary spring and a fixed point behind the martial arts training device. In a version, the bidirectional spring-biased assembly includes a cylinder body having a proximal end and distal end; a rod having a length having an axis, proximal end, a distal end, and a longitudinal slot extending a segment of the length. The rod is reciprocable within the cylinder body. The proximal end of the rod is exposed exterior of the cylinder body and the distal end of the rod terminating at a point within the cylinder body. A piston is affixed to the distal end of the rod. There is at least one rearward countering spring for countering an external force applied to the torso body assembly in the rearward direction, the at least one rearward countering spring operably restrained between the piston and the distal end of the cylinder body. Further, at least one forward countering spring is provided for countering an external force applied to the torso body assembly in a forward direction. The at least one forward countering spring operably restrained between the proximal end of the cylinder body and the piston.

In other versions, at least one bidirectional spring-biased assembly includes a plurality of forward countering springs for countering an external force applied to the torso body assembly in a forward direction. The plurality of forward countering springs are contiguously aligned and positioned between the proximal end of the cylinder body and the piston.

In another version of the application, the cylinder body includes at least one selector hole and the at least one bidirectional spring-biased assembly includes one or more spacer assemblies for separating each forward countering spring from the contiguous forward countering spring. Each spacer assembly has a lateral channel and a longitudinal shaft, the longitudinal shaft adapted to translate the rod freely therethrough and the lateral channel configured to align with the longitudinal slot of the rod and the respective lateral selector hole of the cylinder body when the device is in the default resting position. Thus, the rod longitudinal slot, the spacer lateral channel and the respective lateral selector hole are collectively aligned and configured to selectively receive a selector pin therethrough while in the default resting position.

In yet other versions of the martial arts training device, the plurality of forward countering springs in a series sequentially decrease in spring compression resistance initially from the forward countering spring nearest the piston and ending at the forward countering spring nearest the proximal end of the cylinder body.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

Figure 1:
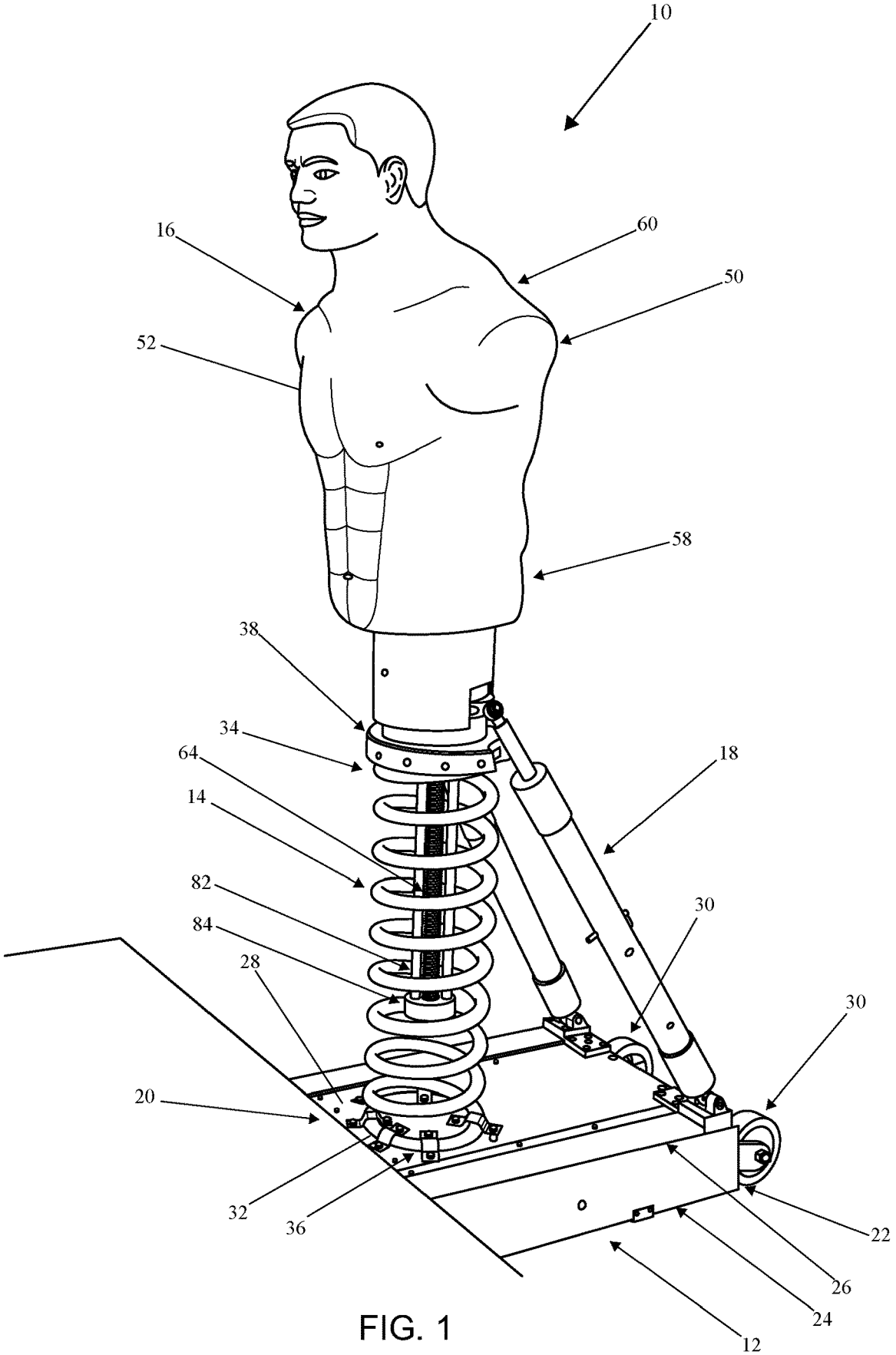
FIG. 1 is a front perspective view of a version of the martial arts training device.

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices, circuits, and methods are omitted so as not to obscure the description of the present invention with unnecessary detail.

Moreover, the description is not to be taken in the limiting sense but is made merely for the purpose of illustrating the general principles of the invention, since the scope of the invention is best defined by the appended claims. Various inventive features are described below that can each be used independently of one another or in combination with other features.

Unless otherwise defined, all technical terms used herein have the same meaning as commonly understood by one of ordinary skill in the art to which the invention belongs. As used in the specification and the appended claims, the singular forms "a," "an," and "the" include plural references unless the context clearly dictates otherwise. Any reference to "or" herein is intended to encompass "and/or" unless otherwise stated.

With reference to the figures, a description of a version of the invention will be provided and is generally designated as numeral 10. Generally speaking, the application is directed towards a martial arts training device, particularly a martial arts training device for training fighters in the art of clinch fighting. The training device 10 is configured to be positioned on a flat surface which can be integrated and used with or alongside other training devices, preferably utilized in a hall or a space dedicated to martial arts training, such as a studio or dojo. Generally, trainees interact with the device which simulates an opponent during a bout, particularly with regard to the clinch position, thus allowing the trainee to build crucial skills with regard to the clinch, one of the most important aspects of being a successful martial artists.

Generally, the training device 10 is fully adjustable to accommodate height and desired resistance for any size of the fighter. The training device 10 also provides realistic hip and waist emulation in conjunction with the bidirectional spring-biased assemblies which allow adjustment of the amount of force in both directions (pushing and pulling) to accurately accommodate every size and strength of the fighter. This allows the fighter to maintain a consistent resistance in every direction while being able to execute precision striking when in the clinch or not in the clinch without risk of injury to a training partner.

With reference to FIG. 1-FIG. 4, a version of the martial arts training device 10 is illustrated. The martial arts training device 10 generally comprises a base assembly 12, a primary spring 14 positioned on the base assembly 12, a torso body assembly 16 positioned above the primary spring 14, and at least one bidirectional spring-biased assembly 18 for yieldable maintaining the torso body assembly 16 in a default, vertical resting position.

As best shown in FIG. 1, the base assembly 12 generally provides support and balance for the other major components of the training device 10 simulating a weighted anchor, particularly supporting the primary spring 14 and the torso body assembly 16. In the version, the base assembly 12 includes a rectangular framework having a forward end 20, a rear end 22, a bottom 24, and a top 26 having a top surface 28. The top surface 28 is generally configured as an attachment platform to support and attach components of the training device 10. Preferably, the top surface 28 extends between the forward end 20 and the rear end 22 at least 20 inches in length, preferably 24 inches, and is made of aluminum in order to properly support the primary spring 14 and other training device 10 components which will be described in more detail below. Generally, the width of the base assembly may be approximately 17 inches.

Preferably, the base assembly 12 is adapted to freely stand on a ground or floor surface. However, the base assembly and other components can be affixed directly to existing structures such as a floor or building wall. Ideally, the base assembly 12 contains a high-density material such as sand, water, lead, or other heavy materials in order to provide weight and stability to the training device 10.

Optionally, as shown in FIG. 1, the training device 10 may provide the function of mobility by utilizing a plurality of wheels 30 which are operably affixed to the rear end 22 of the base assembly 12. The wheels 30 are positioned such that the entirety of the training device 10 can be tilted rearward onto the wheels 30, thus providing movability and portability. In the version, there are two opposing wheels at each side of the rear end 22 of the base assembly 12.

Generally, the torso body assembly 16 is supported above the primary spring 14 which is affixed to the top surface 28 of the base assembly 12. The primary spring 14 has a bottom end 32 and a top end 34. Preferably, the primary spring 14 is has a free length of approximately 26 inches, an outside diameter of 7 and ⅞ of an inch, and an inside diameter of 6 inches and is preferably made of 5160H spring steel providing a compression rating of approximately 350 lb-force/ inch, with a minimum compression rating of 250 lbf/in. In the version, the bottom end 32 of the primary spring 14 is rigidly affixed to the top surface 28 of the base assembly 12 by a plurality of clamps 36 which are radially aligned about the bottom end 32 portion of coil.

Referring to FIG. 1, FIG. 7, and FIG. 15-FIG. 17, the training device 10 may include a cap assembly 38 which generally connects the top end 34 spring coil of the primary spring 14 to the torso body assembly 16. In the illustrated version, the cap assembly 38 is radial in nature and generally comprises a radial lower portion 42 for coupling and affixing to the top end 34 coil of the primary spring 14, and a housing 44 positioned above the radial lower portion 42 for cooperating with and supporting the torso body assembly 16.

Figure 15:
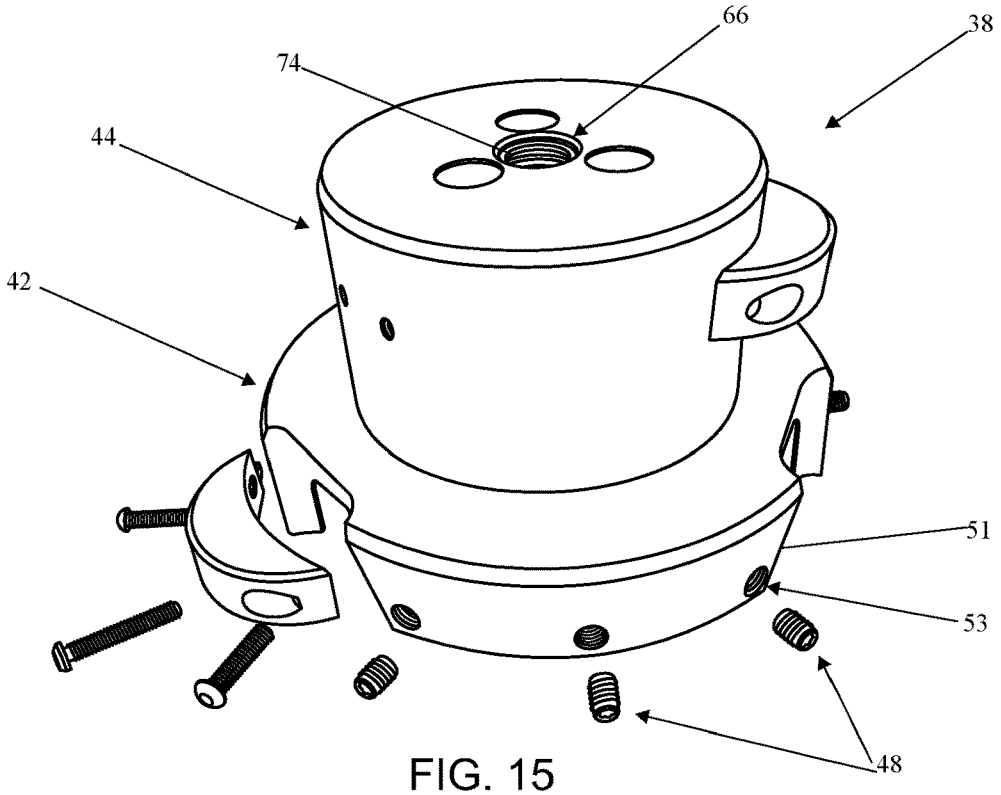
FIG. 15 is a perspective view of the cap assembly partially unassembled.
Figure 16:
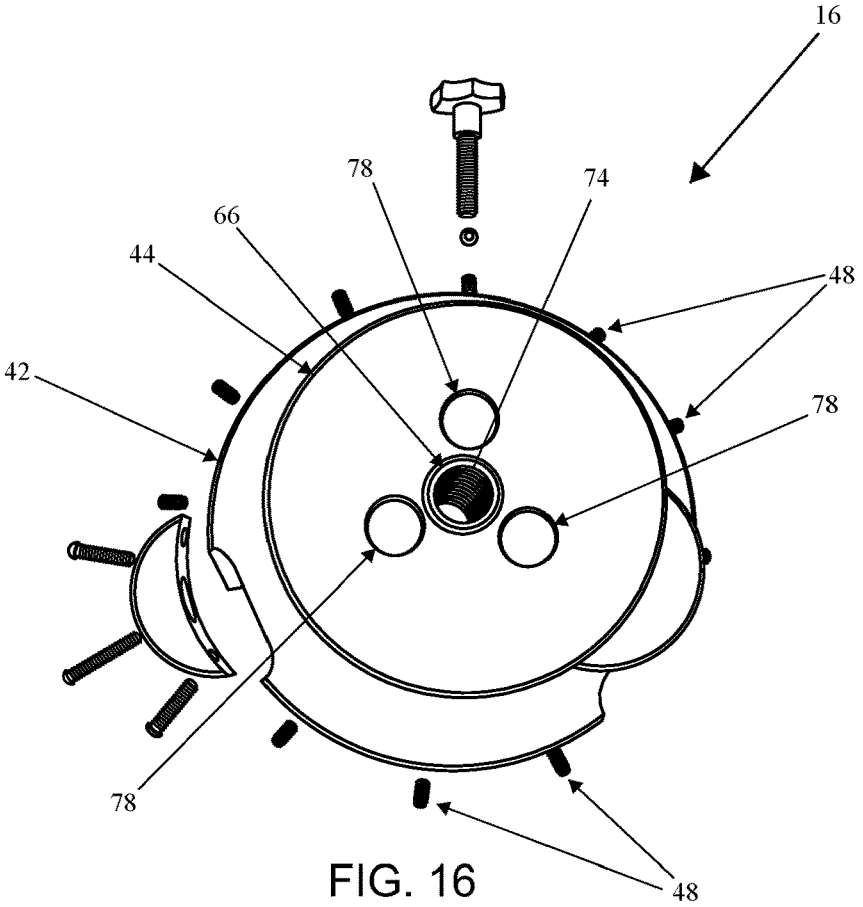
FIG. 16 is a top view of the cap assembly of FIG. 15 partially unassembled.
Figure 17:
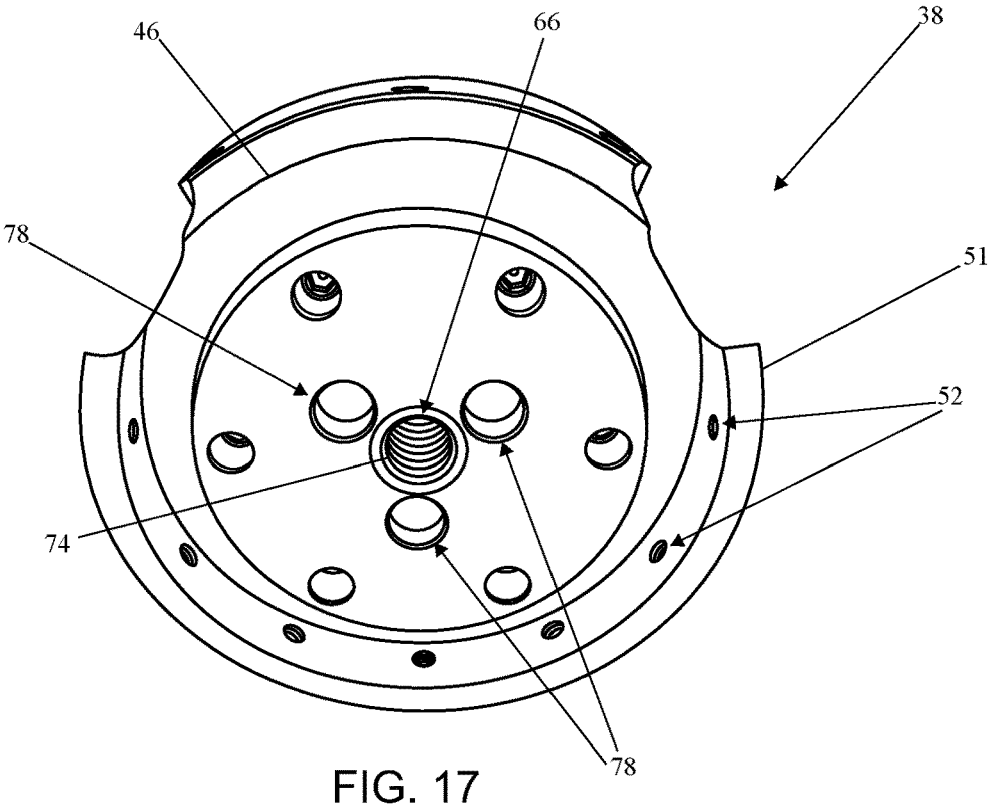
FIG. 17 is a bottom view of the cap assembly of FIG. 15.

With reference to FIG. 15-FIG. 17, in the illustrated version, the radial lower portion 42 generally forms a radial channel 46 adapted to seat the top end 34 coil of the primary spring 14 therein. The width of the radial channel 46 is generally the diameter of the primary spring coil diameter. A plurality of threaded bolts 48 are utilized to secure the top end of 34 or the primary spring 14 coils via threading which allows the threaded bolt 48 to pass through the cap assembly 38 radial lower portion 42 wall 51 via reciprocally threaded apertures 53 thereby entrapping the top end 34 of the primary spring 14 within the radial channel 46.

Figure 2:
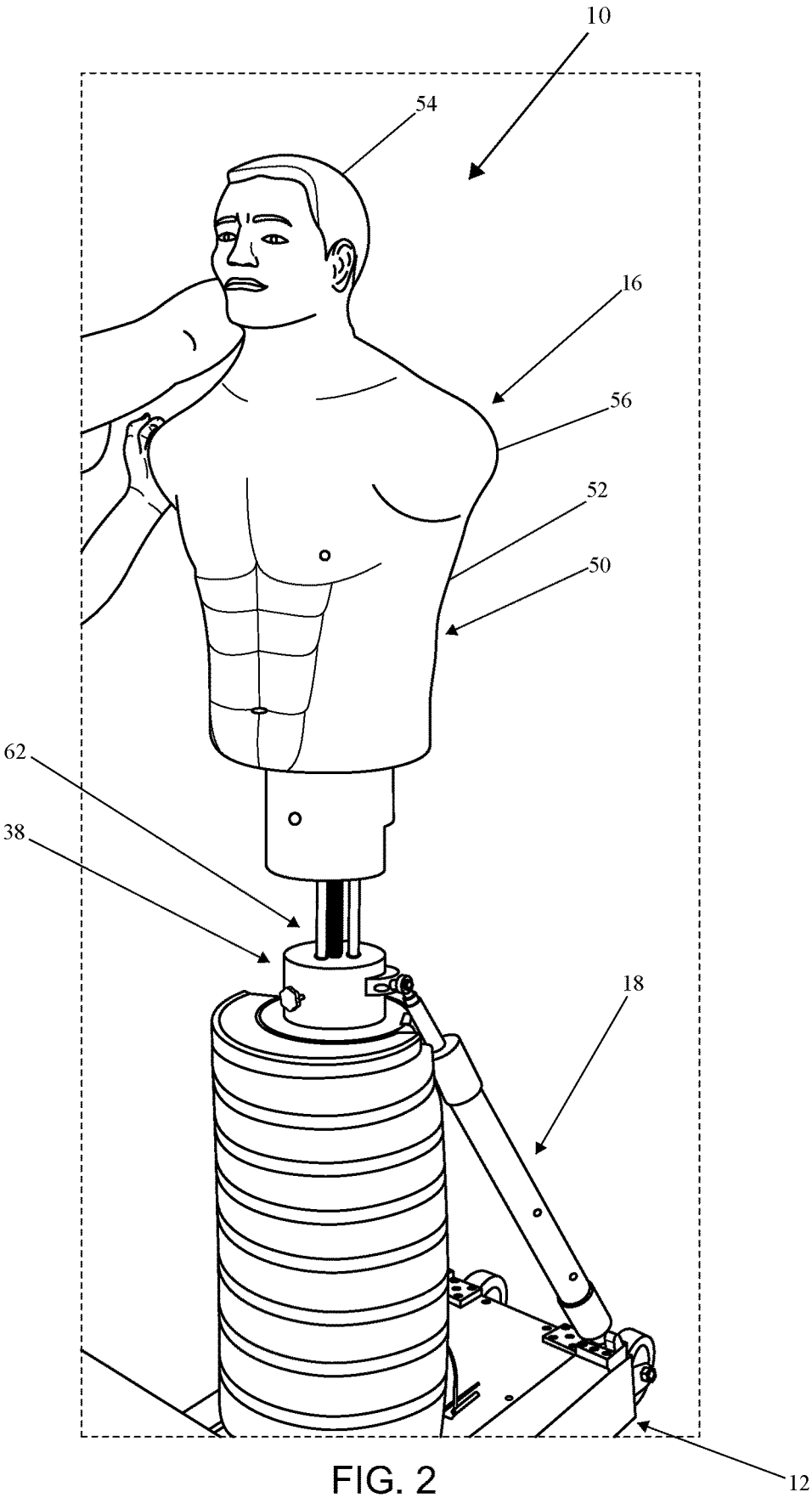
FIG. 2 is a front perspective view of the version shown in FIG. 1 shown while in the default upright position.
Figure 3:
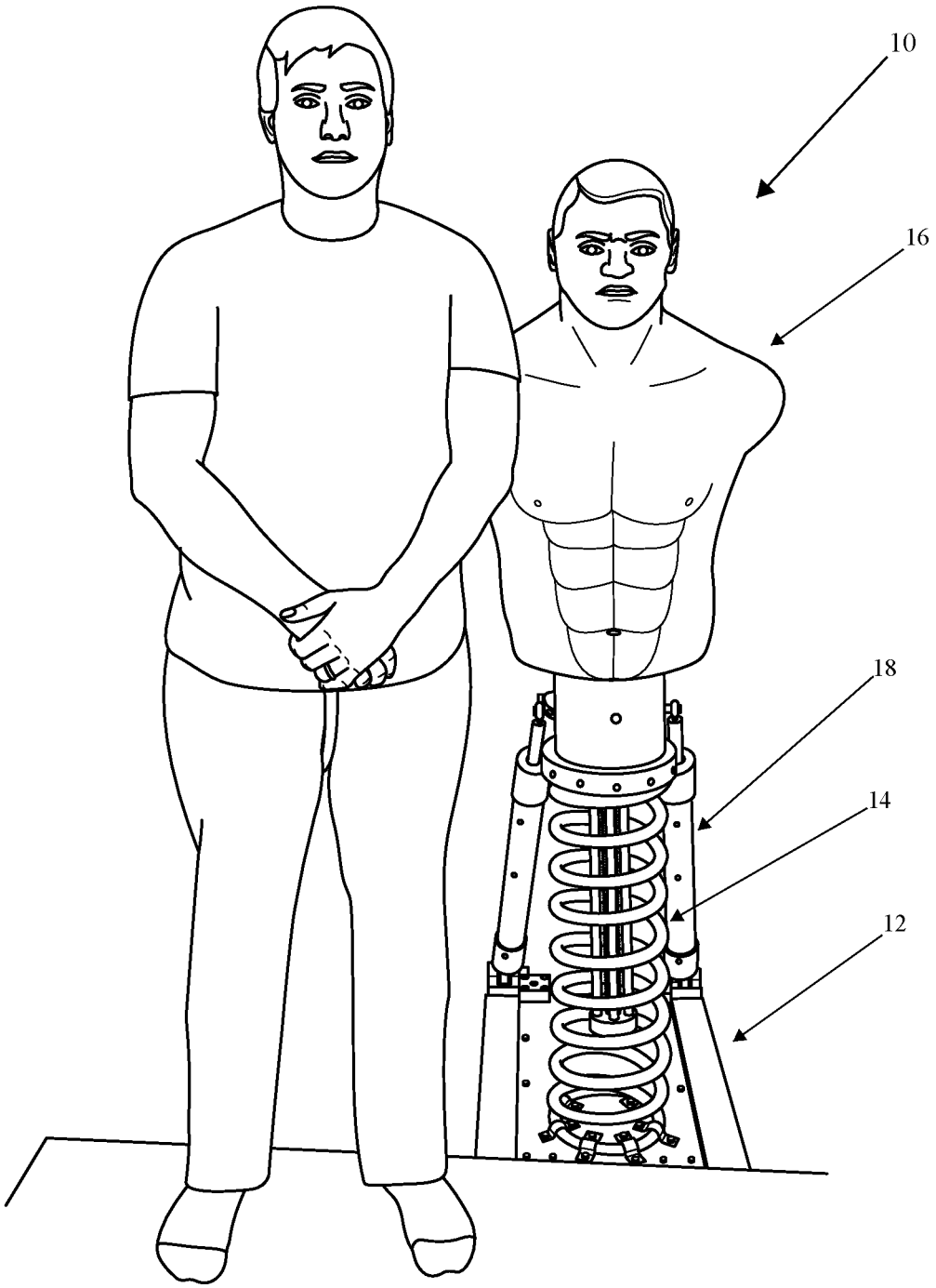
FIG. 3 is a front view of the version shown in FIG. 1 shown while in the torso downward position.
Figure 4:
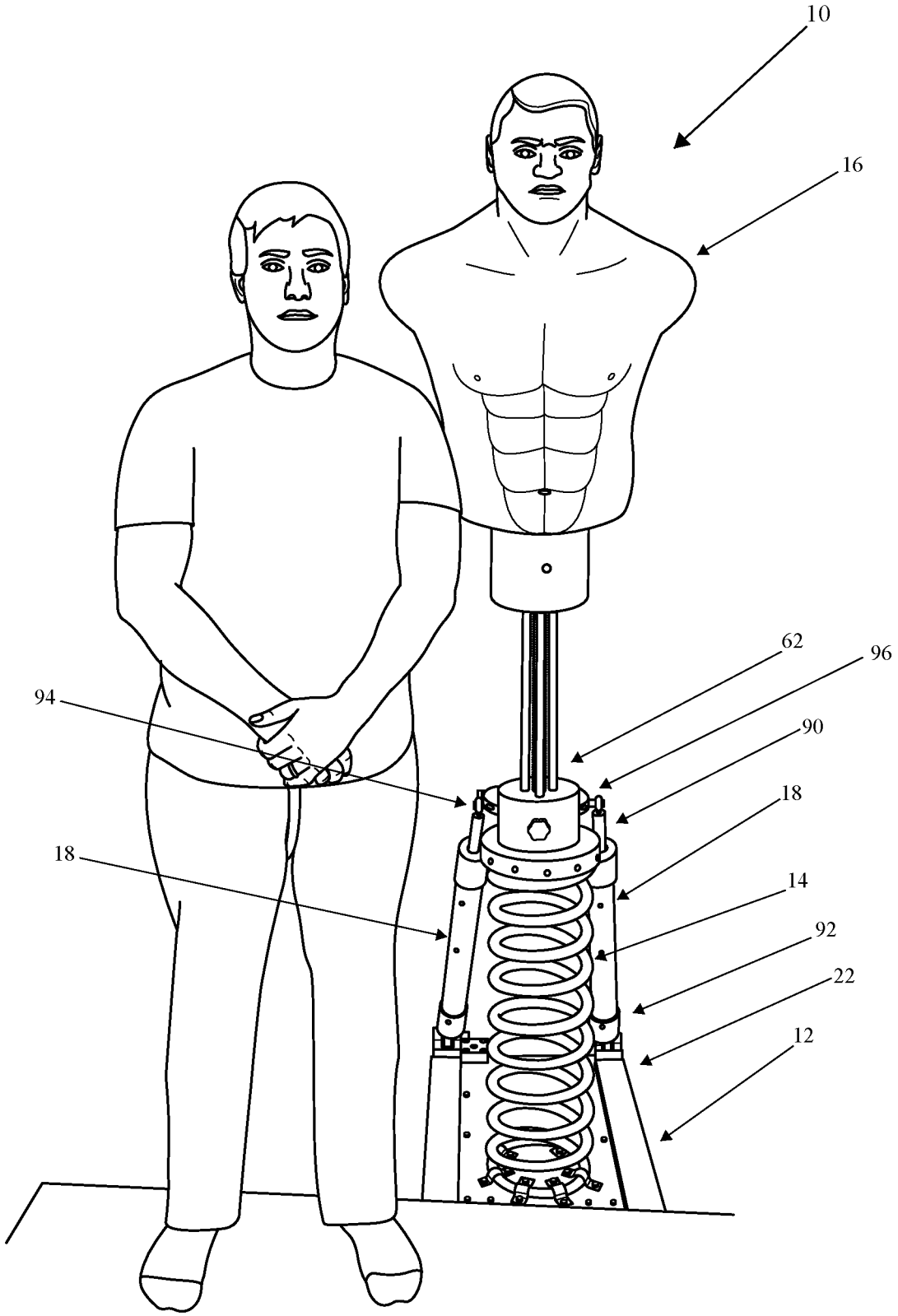
FIG. 4 is a front view of the version shown in FIG. 1 shown while in the torso upward position.

FIG. 1 and FIG. 2 reveal the torso body assembly 16 which includes a body portion 50 configured and contoured to simulate the torso 52, head 54, and partial arms and shoulders 56 of an opponent. The body portion 50 generally constitutes a padding having a lower end 58, an upper end 60, an outer rubber layer simulating skin which is operably configured to be contacted by the trainee during use of the training device 10. Preferably, the padding is a high density urethane foam and has a high-strength plastisol skin covering which is operably designed to absorb hits. Alternatively, the body portion 50 may take on other desirable shapes, for example the body portion 50 may have a more simplistic oval contour or may be more detailed in nature providing a complete torso 52 with arms.

In certain versions of the application and as best illustrated by FIG. 1-FIG. 4, a vertical adjustment assembly 62 is provided which functions to translate the torso body assembly 16 and body portion 50 between a downward position (See FIG. 3) and an upward position (see FIG. 4) relative to the base assembly 12 or primary spring 14. This allows the training device 10 to operably simulate a range of opponent heights. For example, the height or distance between the floor surface to the top of the head 54 of the torso body assembly 16 can selectively range between 5' 2" to 6' 7". Thus, trainees can adjust the height of the training device 10 in order to allow them to clinch train against simulated opponents having realistic height ranges.

Figure 7:
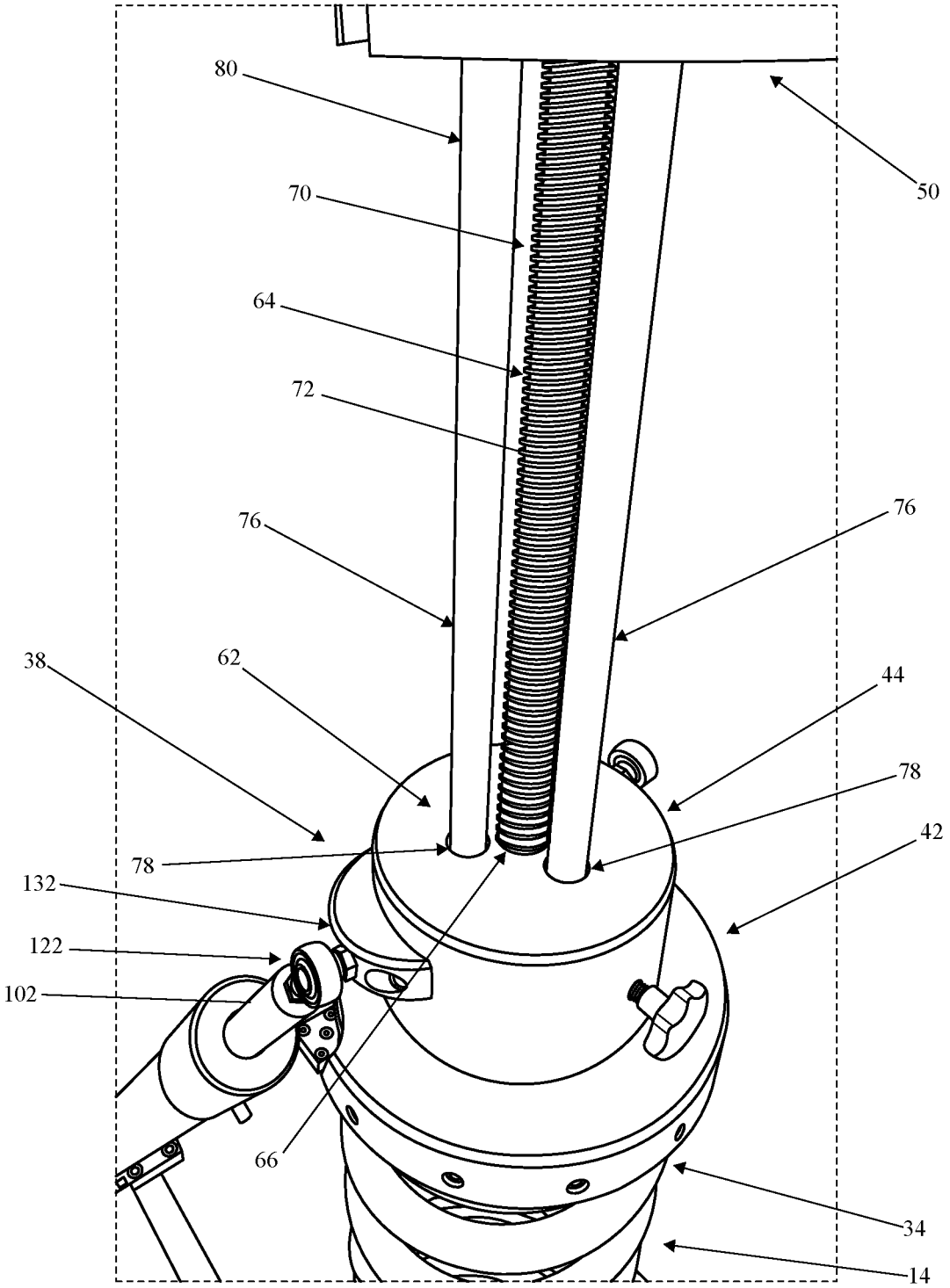
FIG. 7 is a front side view of the vertical adjustment assembly and the cap assembly of the version shown in FIG. 1 shown while in the torso upward position.

The vertical adjustment assembly 62 can be any mechanism which operably changes the relative distance between the body portion 50 and the base assembly 12, thereby providing a range of heights of the martial arts training device 10. In a version as shown in FIG. 7, the vertical adjustment assembly 62 generally comprises the combination of a threaded linear screw 64 attached below the body portion 50 and a reciprocally threaded vertical through-hole 66 disposed through the cap assembly 38 housing 44. The linear screw 64 centrally extends from an upper end 68 (See FIG. 14) embedded within the body portion 50 to a lower end 70 exposed below the body portion 50—providing an acme type male threading 72 or a form of trapezoid thread. In a reciprocal manner, the cap assembly 38 housing 44 provides the vertical through-hole 66 which is adapted to receive and translate the linear screw 64 therethrough—utilizing reciprocal female acme threading 74 (See FIG. 15-FIG. 17 cap assembly). Thus, as the linear screw 64 is caused to rotate, the relative distance between the cap assembly 38 and the body portion 50 is either increased or decreased depending on the direction of rotation, thus ultimately adjusting the overall height of the training device 10.

In other versions, the vertical adjustment assembly 62 can be of a rack and pinion or screw and pinion configuration—or any combination of elements which impart movable distance between the cap assembly 38 and the body portion 50.

Further, in the illustrated version (FIG. 5), one or more guide rods 76 are affixed to the torso body assembly 16 extending downward and radially positioned about the linear screw 64. The guide rods 76 having an upper end 80 and a lower end 82 are operably adapted to translate through the cap assembly 38 by vertically disposed axial bearings 78. With reference to FIG. 7 and FIG. 15, the cap assembly 38 comprises three radially positioned vertical axial bearings 78 configured to receive and translate the three respective guide rods 76. Thus, as the relative distance between the body portion 50 assembly and the cap assembly 38 is adjusted by the rotation of the linear screw 64, the guide rods 76 in combination with the reciprocal axial bearings 78 assist with linear and lateral stabilization of the martial arts training device 10. Preferably, the guide rods 76 are made of stainless steel or are chrome plated. Preferably, the guide rods 76 are at least 40 inches long, preferably 41.875 inches in length and 0.75 inches in diameter, and the reciprocating axial bearings 78 are at least 0.755 inches in diameter and not exceeding 0.760 inches in diameter in order to achieve a tight slip fit without affecting rigidity.

Figure 5:
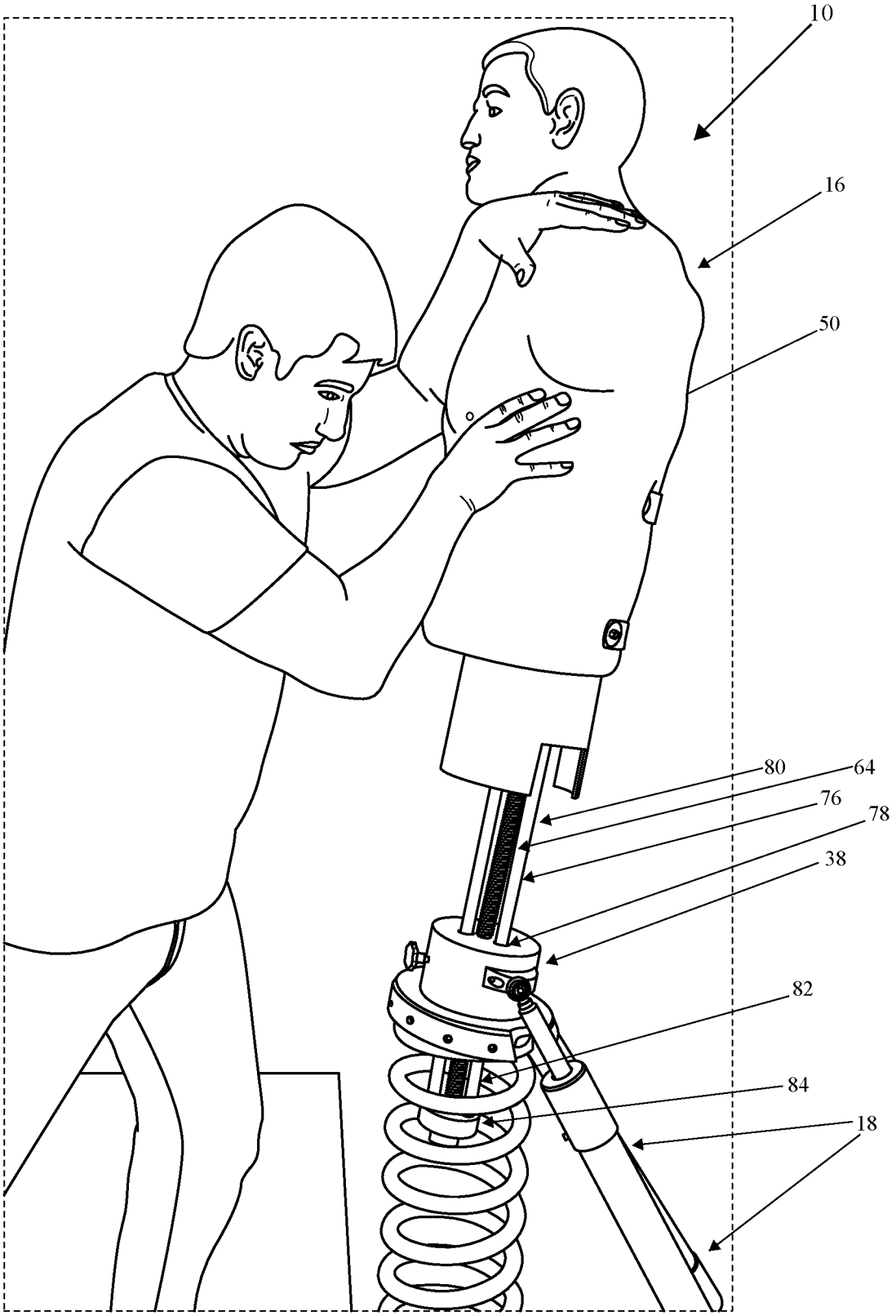
FIG. 5 is a side view of the version shown in FIG. 1 shown while a rearward force is applied to the torso.

Further, in certain versions of the application, a limiting connection member 84 is utilized in order to limit vertical upward movement and define the upward max height of the body portion 50. In the version as shown in FIG. 5, the limiting connection member 84 is fixedly attached to the lower end 70 of the linear screw 64 and the lower ends 82 of each of the guide rods 76. In the version, the limiting connection member 84 resembles the form of a disk, wherein the limiting connection member 84 limits the vertical adjustment assembly at the upward position (See FIG. 4).

Figure 13:
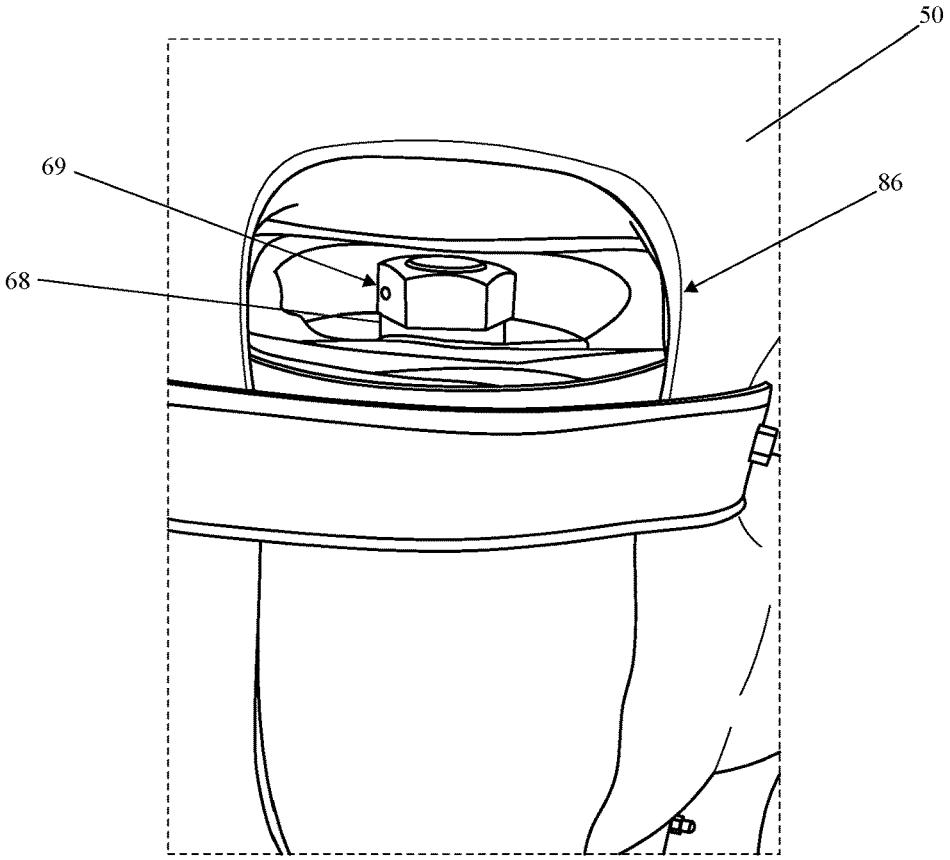
FIG. 13 is a rear perspective view of the upper end of the linear screw exposed at the rear of the torso body portion.
Figure 14:
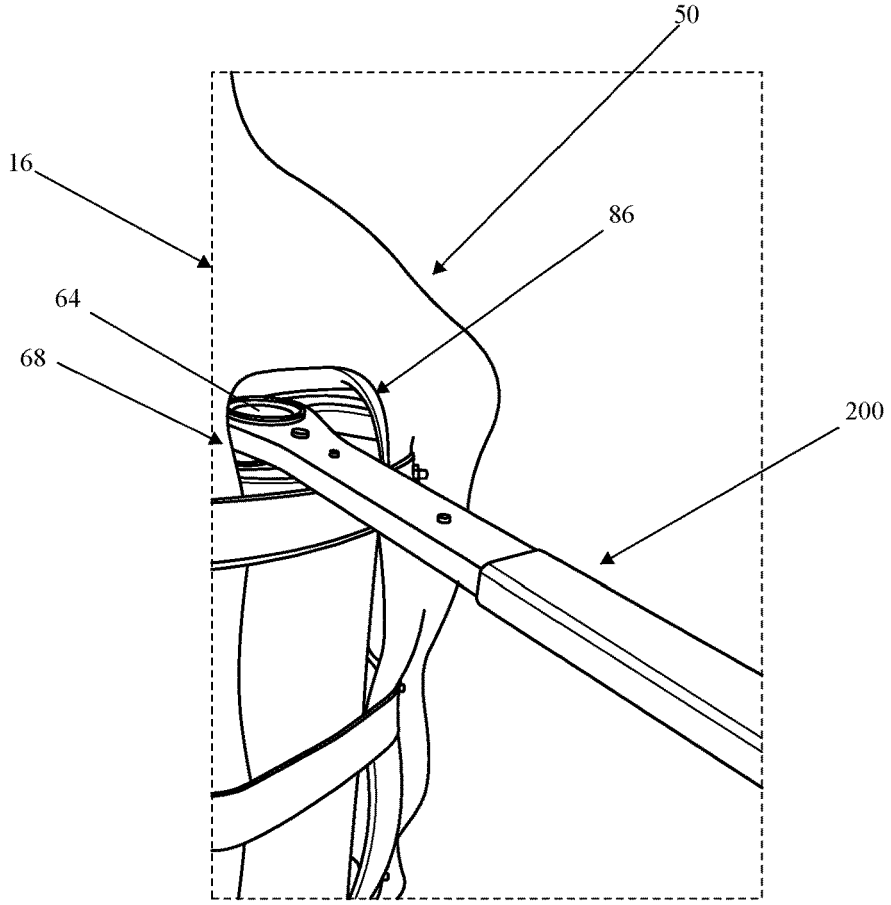
FIG. 14 is a rear perspective view of an active adjustment of the vertical adjustment assembly via a wrench and the upper end of the linear screw.

As best illustrated by FIG. 13 and FIG. 14, the rotation of the linear screw 64 is imparted at the upper end of the screw which is exposed at an access port 86 embedded within the rear of the body portion 50. A wrench 200 is utilized in order to apply a torque to the upper end 68 which terminates at a means to rotate or hexagonal cap 69 of the linear screw 64 which imparts rotation thereof in a clockwise or counterclockwise manner in order to increase or decrease to the desired height of the training device 10.

With reference to the figures, the martial arts training device 10 may further comprise a means for inhibiting movement and yieldably maintain the body portion 50 in a default vertical resting position (See FIG. 1 position), therefore countering variable force applied to the body portion 50 by a trainee in a forward, sideward, or rearward direction in conjunction with the primary spring 14. In other terms, the means for inhibiting movement 18 further inhibits the movement of the body portion 50 which properly simulates resistance that would be encountered during a fight, particularly with regard to a fight involving the clinch movement.

With reference to FIG. 4-FIG. 12, the means for inhibiting movement 18 is at least one bidirectional spring-biased assembly 18 having a proximal end 90 and a distal end 92.

Preferably, the bidirectional spring-biased assembly 18 is generally attached between the cap assembly 38 and a fixed position, for example, the base assembly 12 or an adjacent wall, floor or other anchored structure. In the version, the proximal end 90 of the bidirectional spring-biased assembly 18 is hingedly and operably attached to opposing sides 94, 96 of the cap assembly 38 and the distal end 92 is hingedly attached to the rear end 22 of the base assembly 12. Preferably, there are at least two laterally positioned bidirectional spring-biased assemblies 18 in order to provide improved constant lateral and longitudinal resistance to force that is applied to the torso body assembly 16. In other versions, the bidirectional spring-biased assembly 18 is operably affixed between the rear of the torso body assembly 16 and an adjacent or nearby wall 202 (See FIG. 18) in order to maintain a direct line of resistance as the height is adjustable.

Figures 8A, 8B:
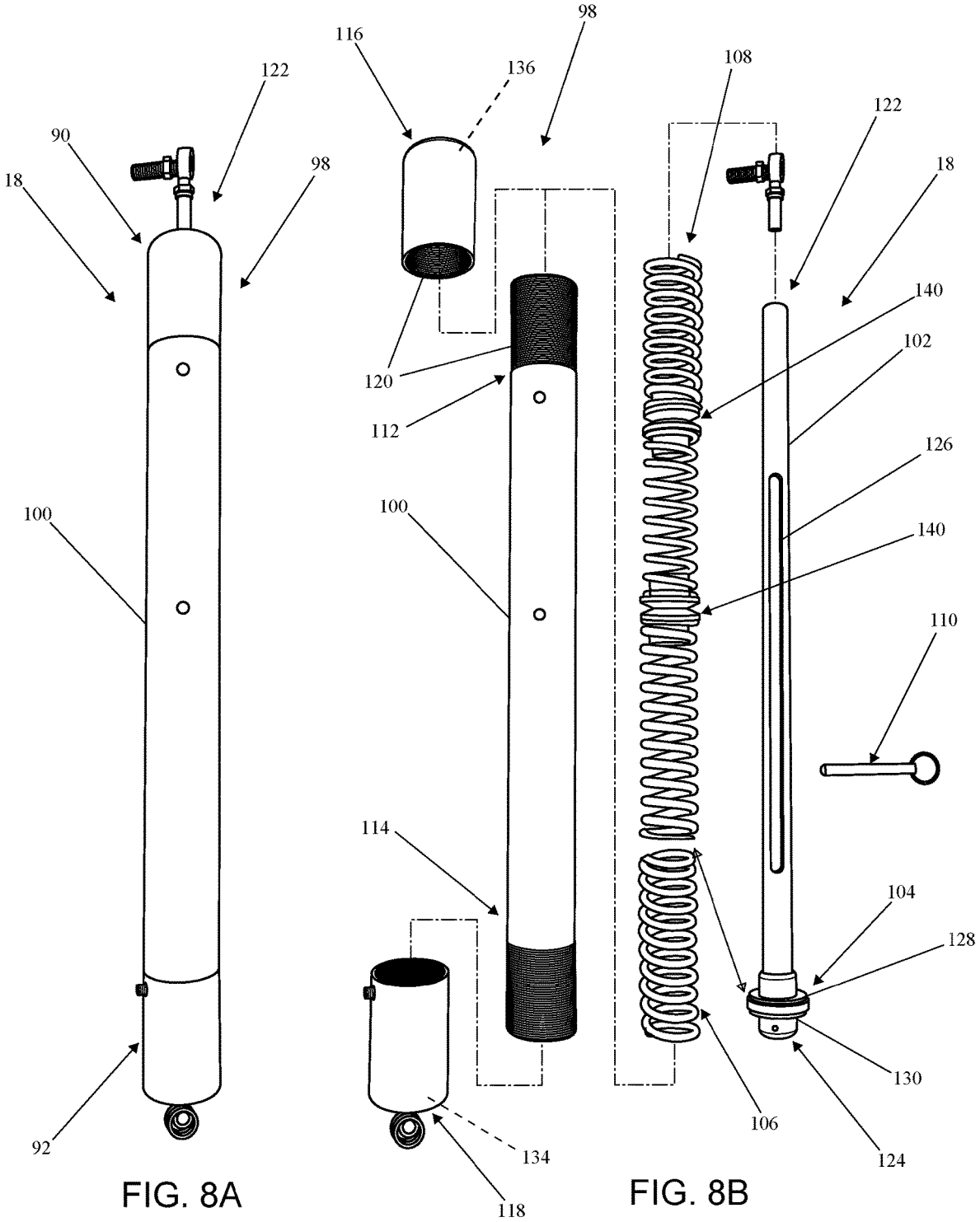
FIG. 8A is an assembled view of the bidirectional spring-biased assembly.
FIG. 8B is an unassembled view of the bidirectional spring-biased assembly of the version shown in FIG. 8A.
Figure 18:
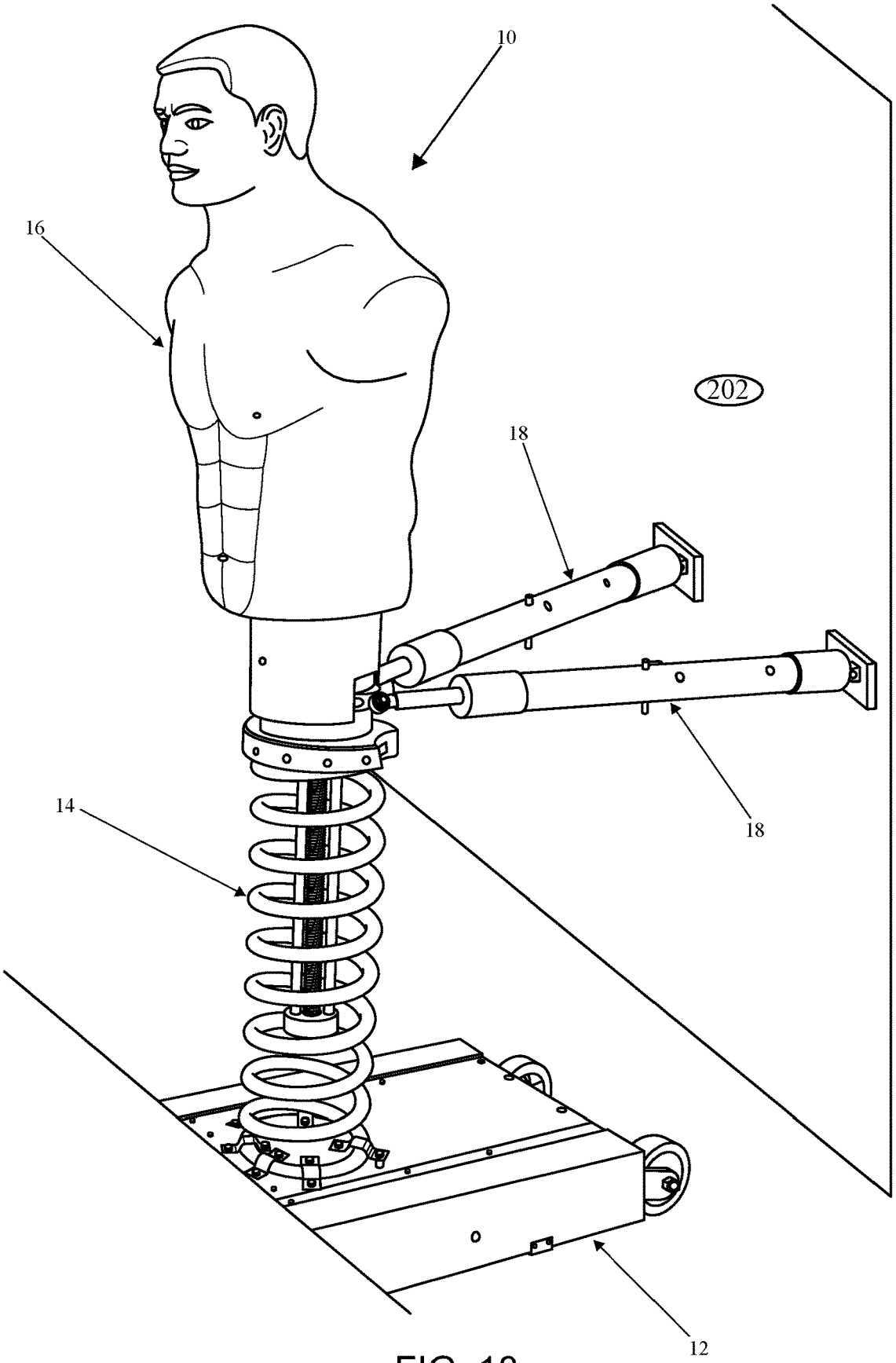
FIG. 18 is a perspective view of a version of the application showing the bidirectional spring-biased assembly operably attached to a wall.

Preferably, the bidirectional spring-biased assembly 18 is operably connected to a point somewhere above the primary spring 14 and a fixed point behind the martial arts training device, such as either connected to the base assembly 12 or an adjacent wall 202 (FIG. 18). With reference to FIG. 8A and FIG. 8B, the bidirectional spring-biased assembly 18 generally comprises a cylinder housing assembly 98 having a cylinder body 100; a rod 102 terminating at a piston 104 translatable within the cylinder body 100; at least one rearward countering spring 106 positioned aft of the piston 104 restrained within the cylinder body 100; and at least one forward countering spring 108 positioned forward of the piston 104 and restrained within the cylinder body 100.

Generally, when a force is applied to the torso body assembly 16 in the rearward direction (trainee pushing on body portion—See FIG. 5), the rearward countering spring(s) 106 are compressed and engaged via the piston 104 within the cylinder body 100 which actively provides resistance or countering force to the rearward motion of the body portion 50. Oppositely, when a force is applied to the torso body assembly 16 in the forward direction (trainee pulling on torso body portion—See FIG. 6), the forward countering springs 108 are compressed and engaged via the piston 104 and/or by selective engagement by a selector pin 110 within the cylinder body 100 which provides active resistance or countering force to the forward motion of the body portion 50.

In the illustrated version, the cylinder housing assembly 98 comprises the cylinder body 100 having a proximal end 112 and a distal end 114; a proximal housing cap 116; and a distal housing cap 118. The proximal housing cap 116 operably encloses the proximal end 112 of the cylinder body 100 and the distal housing cap 118 operably encloses the distal end 114 of the cylinder body 100. The proximal housing cap 116, the distal housing cap 118, and the cylinder body 100 form together an elongated cylindrical enclosure. Preferably, the housing caps 116, 118 are removable via reciprocal threading 120 in order to gain access to the interior thereof. Preferably, the cylinder body 100 is approximately 2.25 inches in diameter with a 2 inch bore hole. The length of the cylinder body 100 is preferably at least 24 inches in order to accommodate a plurality of countering springs; however, other lengths may be required in order to accommodate an increased number of springs.

As best shown in FIG. 7, FIG. 8A, and FIG. 8B, the rod 102 has a longitudinal length, proximal end 122, a distal end 124, and a selector pin longitudinal slot 126. The selector pin longitudinal slot 126 extends a segment of the longitudinal length of the rod 102 adapted to receive the selector pin 110 laterally therethrough and simultaneously allows the selector pin 110 to freely move longitudinally within and relative to the rod 102. The rod 102 is mostly contained and operably reciprocable within the cylinder housing assembly 98, wherein the proximal end 122 of the rod 102 is exposed exterior of the cylinder housing assembly 98 and hingedly attached to the cap assembly 38 contact point 132 (See FIG. 7). The distal end 124 of the rod 102 terminates at a point within the cylinder body 100. The piston 104 is affixed to the distal end 124 of the rod 102 and operably translatable and positioned within the cylinder body 100. In the version, the piston 104 is shaped similar to a disk which has opposing proximal and distal surfaces 128, 130 which are perpendicular to the longitudinal axis of the rod 102 and having a diameter approximate the diameter of the cylinder body 100.

Figure 6:
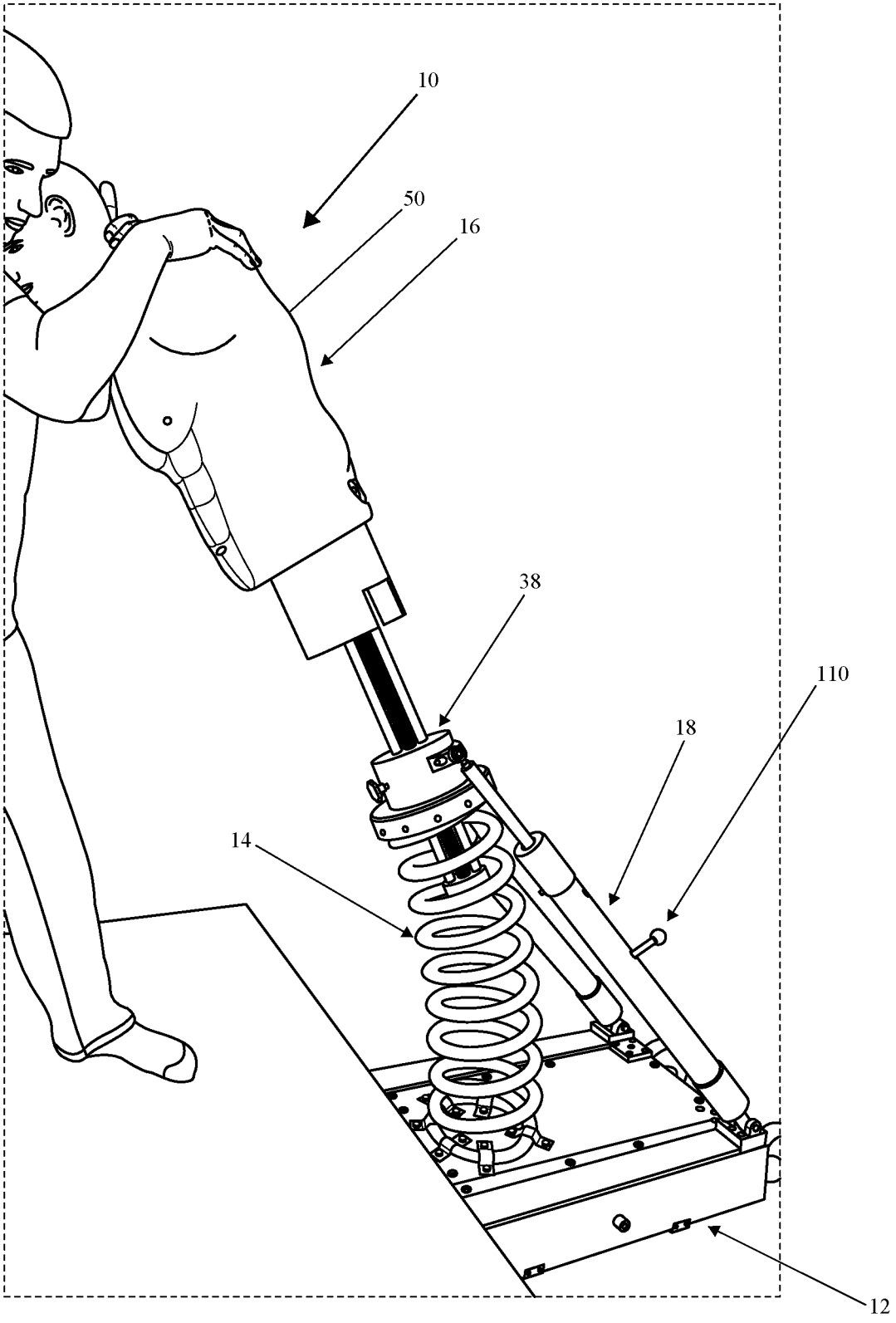
FIG. 6 is a side view of the version shown in FIG. 1 shown while a forward force is applied to the torso.
Figure 9A:
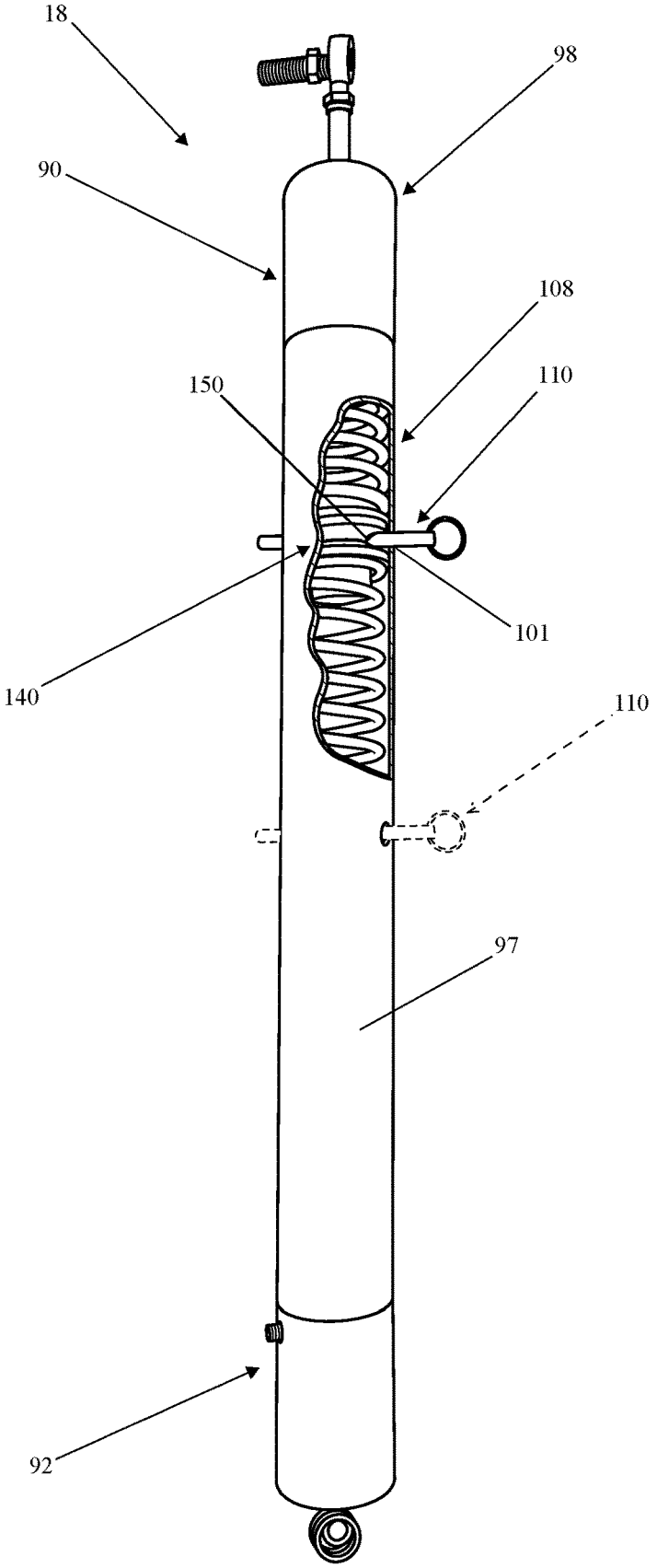
FIG. 9A is a partial sectional view of the assembled bidirectional spring-biased assembly showing internal springs and spacer.
Figure 9B:
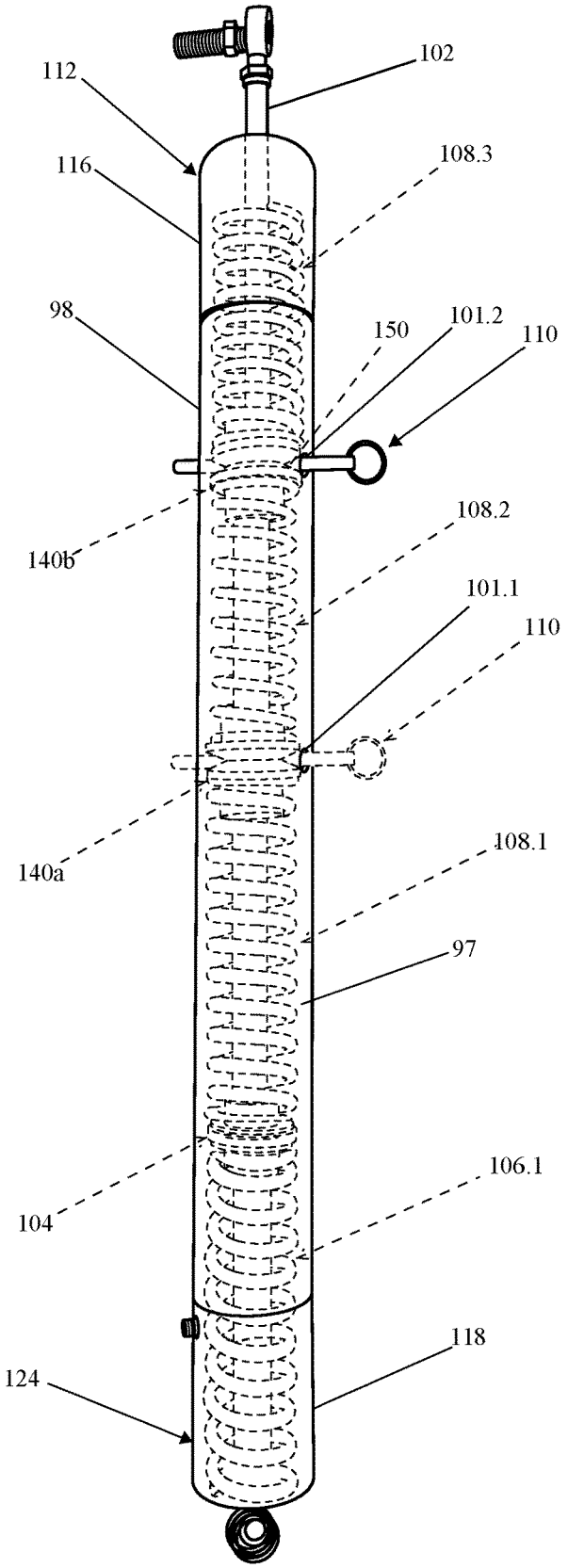
FIG. 9B is a transparent view of the assembled bidirectional spring-biased assembly showing the internal springs and spacers.
Figure 10:
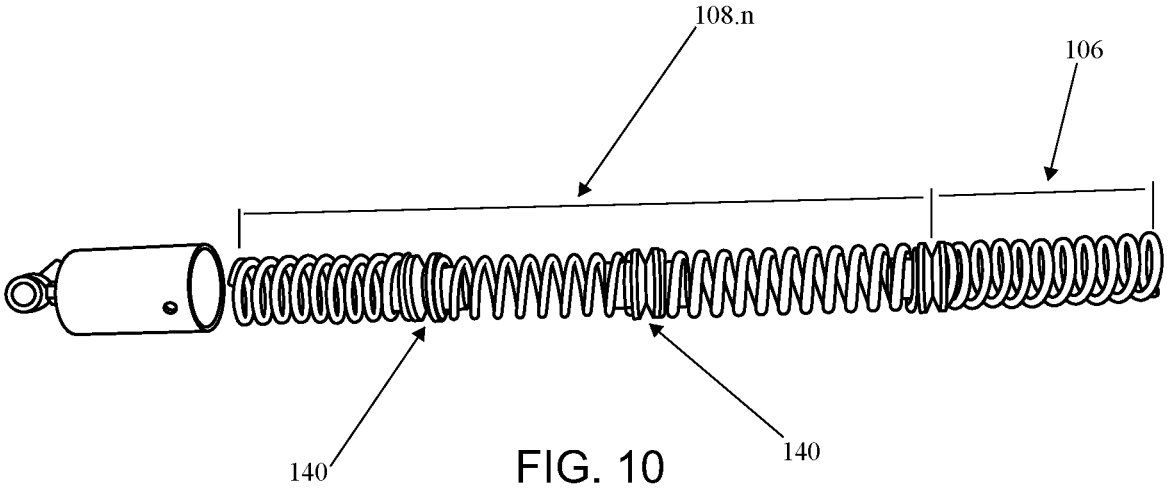
FIG. 10 is a partial view of the assembled bidirectional spring-biased assembly shown without the cylinder body.

In the illustrated version as shown in FIG. 8A-FIG. 10, a plurality of forward countering springs 108.1 . . . **108.*n* are shown for countering force applied to the torso body assembly 16 in a forward direction (See FIG. 6). Thus, when a trainee pulls on the body portion 50, the forward countering springs 108 are compressed and engaged providing resistance of the forward motion of the body portion 50. It is preferable that at least two forward countering springs 108 are utilized so that a variable amount of resistance can be selected which will be described in more detail below. However, other versions may contain a singular forward countering spring 108 or multiple forward countering springs 108.1, 108.2 and 108.3 as illustrated in FIG. 10**.

In the version, there are three forward countering springs 108.1, 108.2, and 108.3 which are generally contiguously axially aligned and positioned between the proximal end 112 of the cylinder housing assembly 98 and the proximal surface 128 of the piston 104. More specifically, the forward countering springs 108 are positioned between the interior end 136 of the proximal housing cap 116 and proximal surface 128 of the piston 104. Thus, as the piston 104 is translated in the forward direction, the forward countering springs 108 collectively are engaged and compressed depending on configuration of engagement, thereby providing a force resistant to the force applied to the body portion 50 of the torso body assembly 16.

In the illustrated version, the plurality of forward countering springs 108 in series 1 . . . n decrease in spring resistance or compression rating sequentially starting from the forward countering spring 108.1 nearest the piston 104 and ending at the forward countering spring 108.3 or **108.*n* nearest the proximal end 112 of the cylinder housing assembly 98. For example, as best shown in FIG. 9B, forward countering spring 108.1 preferably has a compression rating of 400 lbf/in, the forwarding countering spring 108.2 positioned downstream is less than the forward countering spring 108.1 at preferably a compression rating of 200 lbf/in, and the forward countering spring 108.3 provides the least compression rating or resistance at preferably 130 lbf/in terminating prior to the proximal end 90 of the bidirectional spring-biased assembly 18. This consecutive decrease in spring compression resistance provides the user with the ability to selectively determine what the desired overall resistance is to an applied force to the body portion 50 in a forward direction (See FIG. 6**).

As best shown in FIG. 8A-FIG. 12, each of the forward countering springs 108.1 . . . **108.*n* in the series is separated by a neighboring countering spring 108.2 . . . 108.*n* by a spacer assembly 140.1 . . . 140.*n*. Each of the spacer assemblies 140 are configured to align with a respective set of tiered lateral selector holes 101.1 . . . 101.*n* while the bidirectional spring-biased assembly 18 is not under tension in the default position. In the version, the bidirectional spring-biased assembly 18 provides a first spacer assembly 140.1 which separates the first forward countering spring 108.1 and the second forward countering spring 108.2 and is operably aligned with the first set of tiered lateral selector holes 101.1; and a second spacer assembly 140.2 which separates the second forward countering spring 108.2 and the third countering spring 108.3 and is operably aligned with the second set of tiered lateral selector holes 101.1. In other versions of the application, subsequent number of forward countering springs 108.1 . . . 108.*n*, spacer assemblies 104.1 . . . 104.*n*, and tiered lateral selector holes 101.1 . . . 101.*n*** can be utilized.

Figure 11:
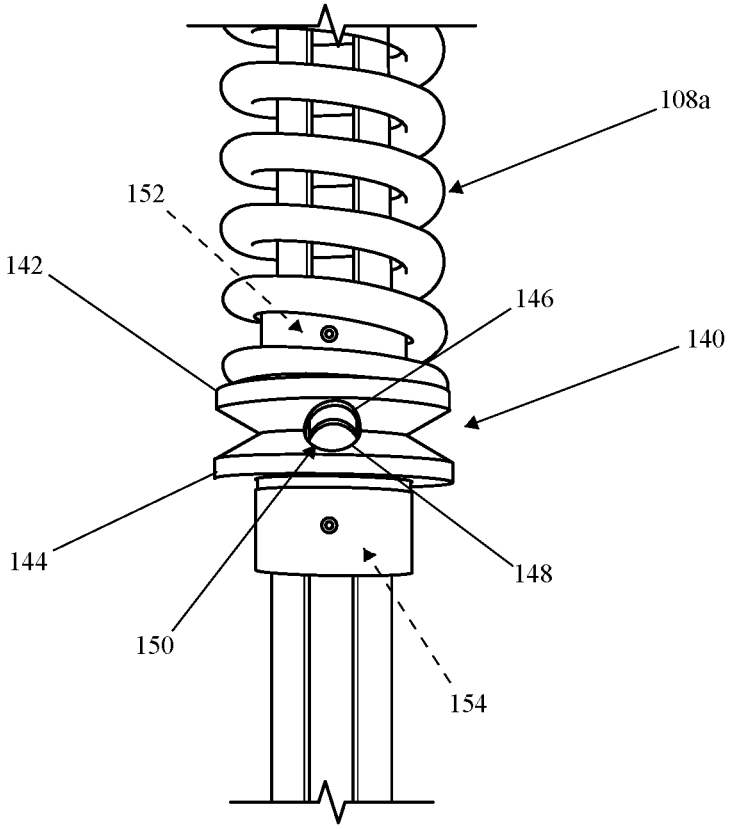
FIG. 11 is a close-up view of the rod, spacer assembly, and spring of the bidirectional spring-biased assembly.

In the illustrated version and as best shown in FIG. 11, the spacer assemblies **140.*a* . . . 140.*n* may comprise a first spacer head 142 adapted to seat within an end of a first forward countering spring 108 and a second spacer head 144 adapted to seat within an end of a second forward countering spring 108. When assembled, the first spacer head 142 and the second spacer head 144 are reciprocally mirrored, each having a lateral channels 146, 148 which when collectively aligned form a lateral hole 150 configured to receive the selector pin 110** therethrough.

Figure 12:
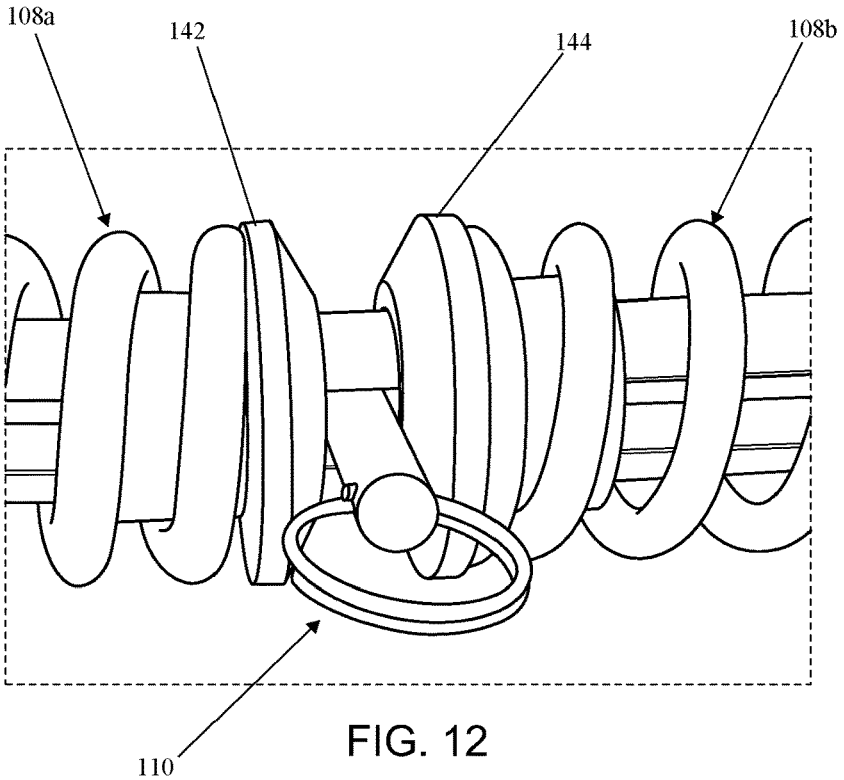
FIG. 12 is a close up view of a version of the spacer assembly, springs, and spring engagement pin of the bidirectional spring-biased assembly.

The first and second spacer heads 142, 144 axially align and are configured to receive and translate the rod 102 freely therethrough via respective longitudinal shafts 152, 154. Thus, the forward countering springs 108 and the spacer assemblies 140 move independent of the movement of the longitudinal length of the rod 102. As shown in FIG. 9 and FIG. 12, while assembled, the selector pin slot 126 of the rod 102 is configured to align with the lateral holes 150 of each of the spacer assemblies 140 and the respective one or more lateral selector holes 101 in the cylinder wall 97, such that the selector pin 110 can be inserted through a lateral selector hole 101, the spacer assembly 140, and the selector pin slot 126 simultaneously. This allows the rod 102 to freely translate within the cylinder housing assembly 98 independent of the inserted selector pin 110. The one or more lateral selector holes may be in sets of tiered lateral selector holes 101 as illustrated in the figures.

Operably, with reference to FIG. 9A and FIG. 9B, the user may select the desired resistance of the forward countering springs 108 by operably selecting one of the following a) engaging the selector pin 110 through the first set of lateral selector holes 101.1, through the respective first space assembly 140.1 which selects the greatest amount of resistance—thus only initially compressing the forward countering spring 108.1 having the greatest compression rating; b) engaging the selector pin 110 through the second set of lateral selector holes 101.2, through the respective second space assembly 140.2 which selects a lesser amount or mid-range of operable resistance—initially compressing only the second forward countering spring 108.2 having a lesser compression rating before compressing the first forward countering spring 108.1 in the series; or c) not engaging any of the space assemblies—initially compressing the third forward countering spring 108.3 having the least amount of compression rating in the series before engaging the second and first forward countering springs 108.2, 108.1 having sequentially higher compression ratings.

Thus, the desired operable forward countering spring 108 resistance can be incrementally decreased by sequentially engaging each spacer assembly 140.1 . . . **140.*n* via each respective set of tiered lateral selector holes 101.1 . . . 101.*n*, starting from the spacer assembly 140.1 adjacent to the piston 104 towards the proximal end 90 of the bidirectional spring-biased assembly 18**.

Further as illustrated, one or more rearward countering springs 106 are disclosed which operate to counter a rearward external force applied to the body portion 50 of the torso body assembly 16 (See FIG. 5). Thus, when a trainee pushes on the body portion 50, the rearward countering spring 106 is compressed and engaged between the distal surface 130 of the piston 104 and the distal end 114 of the cylinder housing assembly 98, more specifically, the interior surface 134 of the distal housing cap 118. Thus, as the piston 104 is translated rearward, the rearward countering spring 106 is engaged and compressed, thereby providing a force resistant to the force applied to the body portion 50.

In the illustrated version, only one rearward countering spring 106 is shown; however, other versions of the application may have more than one rearward countering spring 106.1 . . . **106.*n* which provide the user the ability to selectively vary the rearward countering resistance compression used to counter the applied force to the torso body assembly 16 in the rearward direction. Preferably, each of the rearward countering springs 106.1 . . . 106.*n* in series, starting from the piston 104 and ending at the distal end 92, are operably separated and engaged by respective spacer assemblies and sets of tiered lateral selector holes numbering from 1 . . . n (not shown and similar to the forward countering springs 108 configuration described above). Preferably, the rear countering spring 106** has a compression rating of approximately 200 lbf/in.

Preferably, in a version not shown, each of the contiguously aligned rearward countering springs 106 in series 1 . . . n decrease in spring compression rating sequentially starting from the spring 106.1 nearest the piston 104 and ending at the spring **106.*n* nearest the distal end of the cylinder housing assembly 98. Thus, as you move away from the piston 104 in series, each rearward countering spring 106** decreases in compression rating.

Generally, the martial arts training device 10 can be made in any manner and of any material chosen with sound engineering judgment. Preferably, materials will be strong, lightweight, long-lasting, economic, and ergonomic. Preferably, the martial arts training device 10 is constructed of a resilient material such as metal, plastic, or a composite.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A martial arts training device comprising:

a primary spring having a bottom and a top;

a torso body assembly affixed to the top of the primary spring; and at least one bidirectional spring-biased assembly for yieldably maintaining the torso body assembly in a default resting position, the at least one bidirectional spring-biased assembly operably connected to a point above the primary spring and a fixed point behind the primary spring, the at least one bidirectional spring-biased assembly comprising:

a cylinder body having a proximal end and a distal end;

a rod having a length, proximal end, a distal end, and a longitudinal slot extending a segment of the length, the rod is reciprocable within the cylinder body, the proximal end of the rod is exposed exterior of the cylinder body and is operably hingedly attached to the point above the primary spring, the distal end of the rod terminating at a point within the cylinder body;

a piston affixed to the distal end of the rod;

at least one rearward countering spring for countering an external force applied to the torso body assembly in the rearward direction, the at least one rearward countering spring operably restrained between the piston and the distal end of the cylinder body; and at least one forward countering spring for countering an external force applied to the torso body assembly in a forward direction, the at least one forward countering spring operably restrained between the proximal end of the cylinder body and the piston.

2. The martial arts training device of claim 1, wherein the at least one forward countering spring comprises a plurality of forward countering springs for countering an external force applied to the torso body assembly in a forward direction, the plurality of forward countering springs contiguously aligned and positioned between the piston and the proximal end of the cylinder body.

3. The martial arts training device of claim 2, wherein the cylinder body comprises at least one selector hole and wherein the at least one bidirectional spring-biased assembly comprises one or more spacer assemblies for separating each of the plurality of forward countering springs from each other, each of the one or more spacer assemblies having a lateral channel and a longitudinal shaft, the longitudinal shaft adapted to translate the rod freely therethrough and the lateral channel configured to align with the longitudinal slot of the rod and the lateral selector hole of the cylinder body while in a default resting position, thereby the rod longitudinal slot, the spacer assembly lateral channel and the respective lateral selector hole are collectively aligned and configured to selectively receive a selector pin therethrough while in the default resting position.

4. The martial arts training device of claim 3, wherein the plurality of forward countering springs in a series 1 . . . n sequentially decrease in spring compression resistance starting from the piston and ending at the proximal end of the cylindrical body.

5. The martial arts training device of claim 1, wherein the at least one rearward countering spring comprises a plurality of rearward countering springs for countering an external force applied to the torso body assembly in a rearward direction, the plurality of rearward countering springs contiguously aligned and positioned between the distal end of the cylinder body and the piston.

6. The martial arts training device of claim 5, wherein the cylinder body comprises at least one lateral selector hole and wherein the at least one bidirectional spring-biased assembly comprises one or more spacer assemblies for separating each of the plurality of rearward countering spring from the contiguous rearward countering spring, each of the one or more spacer assemblies having a lateral channel and a longitudinal shaft, the longitudinal shaft adapted to translate the rod freely therethrough and the lateral channel configured to align with the longitudinal slot of the rod and the lateral selector hole of the cylinder body while in a default resting position, thereby the rod longitudinal slot, the spacer assembly lateral channel and the respective lateral selector hole are collectively aligned and configured to receive a selector pin therethrough while in the default resting position.

7. The martial arts training device of claim 6, wherein the plurality of rearward countering springs in a series 1 . . . n sequentially decrease in spring compression resistance starting from the piston and ending at the distal end of the cylindrical body.

8. The martial arts training device of claim 1, wherein the distal end of the at least one bidirectional spring-biased assembly is operably attachable to a nearby wall.

9. The martial arts training device of claim 1, further comprising a base assembly having a forward end, a rear end, and a top extending between the forward end and the rear end, the base assembly adapted to be positioned on a ground surface and support the primary spring; wherein the distal end of the at least one bidirectional spring-biased assembly is operably connected to the rear end of the base assembly.

10. The martial arts training device of claim 1, wherein the at least one bidirectional spring-based assembly comprises a first bidirectional spring-biased assembly and a second bidirectional spring-biased assembly, the proximal ends of the first and second bidirectional spring-biased assemblies operably connected and disposed at opposing sides of the device above the primary spring.

11. A martial arts training device comprising:

a base assembly having a top;

a primary spring affixed to the top of the base assembly, the primary spring having a top and a bottom;

a torso body assembly;

a vertical adjustment assembly adapted to vertically translate the torso body assembly between a downward position and an upward position; and at least one bidirectional spring-biased assembly for yieldably maintaining the torso body assembly in a default resting position, the at least one bidirectional spring-biased assembly operably connected to a point above the primary spring and a fixed point behind the martial arts training device, the at least one bidirectional spring-biased assembly comprising:

a cylinder body having a proximal end and distal end;

a rod having a length having an axis, proximal end, a distal end, and a longitudinal slot extending a segment of the length, the rod is reciprocable within the cylinder body, the proximal end of the rod is exposed exterior of the cylinder body, the distal end of the rod terminating at a point within the cylinder body;

a piston affixed to the distal end of the rod;

at least one rearward countering spring for countering an external force applied to the torso body assembly in the rearward direction, the at least one rearward countering spring operably restrained between the piston and the distal end of the cylinder body; and at least one forward countering spring for countering an external force applied to the torso body assembly in a forward direction, the at least one forward countering spring operably restrained between the proximal end of the cylinder body and the piston.

12. The martial arts training device of claim 11, wherein the vertical adjustment assembly comprises a cap assembly having a through hole and affixed to the top of the primary spring, and a linear screw attached to the torso body assembly and cooperating with the cap assembly through hole.

13. The martial arts training device of claim 12, wherein the vertical adjustment assembly further comprises one or more guide rods radially disposed about the linear screw extending below the torso body assembly and the cap assembly further comprises one or more axial bearings coupled to receive the respective one or more guide rods therethrough.

14. The martial arts training device of claim 13, wherein the vertical adjustment assembly further comprises a limiting connection member attaching a lower end of the linear screw and lower end of each guide rod, wherein the limiting connection member limits the vertical adjustment assembly at the upward position.

15. The martial arts training device of claim 11, wherein the at least one forward countering spring comprises a plurality of forward countering springs for countering an external force applied to the torso body assembly in a forward direction, the plurality of forward countering springs contiguously aligned and positioned between the proximal end of the cylinder body and the piston.

16. The martial arts training device of claim 15, wherein the cylinder body comprises at least one selector hole and wherein the at least one bidirectional spring-biased assembly comprises one or more spacer assemblies for separating each of the plurality of forward countering spring from the contiguous forward countering spring, each of the one or more spacer assemblies having a lateral channel and a longitudinal shaft, the longitudinal shaft adapted to translate the rod freely therethrough and the lateral channel configured to align with the longitudinal slot of the rod and the respective lateral selector hole of the cylinder body when the device is in the default resting position, thereby the rod longitudinal slot, the spacer lateral channel and the respective lateral selector hole are collectively aligned and configured to selectively receive a selector pin therethrough while in the default resting position.

17. The martial arts training device of claim 16, wherein the plurality of forward countering springs in a series 1 . . . n sequentially decrease in spring compression resistance starting from the piston and ending at the proximal end of the cylindrical body.

18. The martial arts training device of claim 11, wherein the distal end of at least one of the at least one bidirectional spring-biased assembly is hingedly connected to the base assembly.

19. A martial arts training device comprising:

a base assembly having a forward end, a rear end, and a top extending between the forward end and the rear end, the base assembly adapted to be positioned on a ground surface;

a primary spring having a bottom and a top, the bottom of the primary spring affixed to the top of the base assembly;

a torso body assembly constructed partially of a padding and having a head portion;

a vertical adjustment assembly positioned below the torso body portion and adapted to vertically translate the torso body portion between a downward position and an upward position, the vertical adjustment assembly comprising:

a cap assembly affixed to the top of the primary spring, the cap assembly comprising a vertical screw through hole having threads and one or more axial bearings;

a linear screw having a lower end and an upper end, the lower end operably engaging the screw through hole of the cap assembly, the upper end of the linear screw having a means to rotate which is exposed at the rear of the torso body portion;

one or more guide rods radially disposed about the linear screw, each of the one or more guide rods operably coupled with the respective one or more axial bearings of the cap assembly, each of the one or more guide rods having a lower end; and a limiting connection member attaching the lower ends of the linear screw and each of the one or more guide rods, wherein the limiting connection member limits the vertical adjustment assembly at the upward position; and at least one bidirectional spring-biased assembly for yieldably maintaining the torso body assembly in a default resting position, the at least one bidirectional spring-biased assembly comprising:

at least one selector pin;

a cylinder housing assembly comprising:

a cylinder body having a proximal end and a distal end, the cylinder body having a least one set of lateral selector holes adapted to selectively receive the at least one selector pin, a proximal housing cap coupled to the proximal end of the cylinder body, the proximal housing cap having an interior surface, and a distal housing cap operably coupled to the distal end of the cylinder body, the distal housing cap having an interior surface;

a rod having a longitudinal length and a longitudinal axis, proximal end, a distal end, and a slot extending a segment of the longitudinal length adapted to receive the at least one selector pin laterally therethrough, the rod is reciprocable within the cylinder housing assembly, the proximal end of the rod is exposed exterior of the cylinder body and is operably hingedly attached to the cap assembly, the distal end of the rod terminating at a point within the cylinder body;

a piston affixed to the distal end of the rod, the piston having a radial disk having opposing proximal and distal surfaces which are perpendicular to the rod longitudinal axis;

at least one rearward countering spring for countering an external force applied to the torso body assembly in the rearward direction, the at least one rearward countering spring operably restrained between the piston distal surface and the interior end of the distal housing cap;

a plurality of forward countering springs for countering an external force applied to the torso in a forward direction, the plurality of forward countering springs contiguously aligned and restrained between the proximal housing cap and the piston proximal surface; and one or more spacer assemblies for separating each of the plurality of forward countering springs from each other each of the one or more spacer assemblies having a lateral channel and a longitudinal shaft, the longitudinal shaft adapted to translate the rod freely therethrough and the lateral channel configured to align with the longitudinal slot of the rod and the respective set of lateral selector holes of the cylinder body while in the default resting position, thereby the rod longitudinal slot, the spacer lateral channel and the respective set of lateral selector holes are collectively aligned and configured to receive the selector pin therethrough while in the default resting position;

wherein the distal end of each of the bidirectional spring-biased assemblies are hingedly connected to the rear end of the base assembly.

20. The martial arts training device of claim 19, wherein the plurality of forward countering springs in a series 1 . . .

n sequentially decrease in spring compression resistance starting from the piston and ending with the proximal end of the cylindrical housing assembly.

* * * * *